United States Patent [19]

Mecham

[11] B 3,983,050

[45] Sept. 28, 1976

[54] METHOD FOR STORAGE OF SOLID WASTE

[75] Inventor: William J. Mecham, La Grange, Ill.

[73] Assignee: The United States of America as represented by the United States Energy Research and Development Administration, Washington, D.C.

[22] Filed: Feb. 7, 1975

[21] Appl. No.: 548,058

[44] Published under the second Trial Voluntary Protest Program on February 17, 1976 as document No. B 548,058.

[52] U.S. Cl. ..... 252/301.1 W; 206/84; 220/10; 250/506; 250/507; 250/515; 428/912

[51] Int. Cl.[2] ..... G21F 5/00

[58] Field of Search ..... 252/301.1 W; 206/84; 250/506, 507, 515; 106/97; 220/63 A, 10; 428/912, 35

[56] References Cited

UNITED STATES PATENTS

| | | | |
|---|---|---|---|
| 3,152,984 | 10/1964 | Winsche et al. | 252/301.1 W |
| 3,479,295 | 11/1969 | Thompson | 252/301.1 W |
| 3,507,801 | 4/1970 | Kausz et al. | 252/301.1 W |
| 3,828,197 | 8/1974 | Boldt | 252/301.1 W |

FOREIGN PATENTS OR APPLICATIONS

| | | | |
|---|---|---|---|
| 1,109,279 | 6/1961 | Germany | 252/301.1 W |
| 1,173,998 | 7/1964 | Germany | 252/301.1 W |

*Primary Examiner*—Leland A. Sebastian
*Assistant Examiner*—Deborah L. Kyle
*Attorney, Agent, or Firm*—Dean S. Carlson; Arthur A. Churm; James W. Weinberger

[57] ABSTRACT

Metal canisters for long-term storage of calcined high-level radioactive wastes can be made self-sealing against a breach in the canister wall by the addition of powdered cement to the canister with the calcine before it is sealed for storage. Any breach in the canister wall will permit entry of water which will mix with the cement and harden to form a concrete patch, thus sealing the opening in the wall of the canister and preventing the release of radioactive material to the cooling water or atmosphere.

7 Claims, No Drawings

METHOD FOR STORAGE OF SOLID WASTE

CONTRACTUAL ORIGIN OF THE INVENTION

The invention described herein was made in the course of, or under, a contract with the UNITED STATES ATOMIC ENERGY COMMISSION.

BACKGROUND OF THE INVENTION

This invention relates to the storage of high-level wastes for an extended period of time. More specifically, this invention relates to an improvement in the method for the storage of high-level radioactive wastes as solids in metal canisters by making the canisters self-sealing.

A problem facing the nuclear industry which has received much attention is how to dispose of radioactive wastes so that they will never contaminate the biosphere with radioactivity. While disposal of these wastes in a form and in an environment in which no contamination of the biosphere is possible under any conceivable circumstances for the entire period that radioactivity is at a dangerous level is the ultimate objective of waste management engineers, no such disposal procedure has as yet gained wide acceptance. As an alternative or supplement to ultimate disposal, an engineered storage employing buildings, vaults, tanks, etc. which will require continuous surveillance and maintenance for up to 100 years may be employed.

A number of factors must be considered in the development of these storage methods which are to last for 100 years. For example, integrity of the storage container, cost of solidifying the wastes, retrievability of the wastes if necessary for reprocessing and cost of storage must all be considered.

Large volumes of liquid waste have been and are being stored in large tanks. Due to the tremendous cost of storing liquids, considerable effort has gone into programs for developing methods for solidifying these wastes for longterm storage. For example, the use of cement for the fixation of radioactive wastes has been studied extensively, and from a production standpoint, is probably the most convenient way in which to solidify waste. All that is required is that the material to be solidified be mixed with water and the mixture cast into the desired monolithic shape and allowed to set. However, some radioactive salts are readily leachable from concrete and the retrievability of the radioactive material from the concrete may pose some future problems.

Studies are also being conducted into methods for solidifying the liquid wastes by calcining them in a fluidized-bed or batch-type pot calciner or transforming the wastes into glass. In either case, the calcine or glass would then be sealed into metal canisters for storage. Because of the heat developed by the radioactive waste, the canisters must be cooled, either by air or by storage in a water-filled tank. In either environment, the canister is subject to failure of its integrity which may result in the release of radioactive material to the environment.

SUMMARY OF THE INVENTION

A method has been developed which eliminates many of the problems attendent upon the storage of radioactive calcine wastes in a metal canister for long periods of time in a moisture-containing environment such as open-air or water-tank storage. In the method of the present invention, dry cement powder is added to the metal canister containing the calcined wastes so that the cement powder is in contact with the inner surface of the wall of the canister before the canister is sealed whereby, should the canister wall fail and develop an opening to the environment, moisture from the environment will enter the canister, mix with the Portland cement, forming concrete which will harden, seal the opening and prevent the escape of any radioactivity from the canister into the environment.

It is therefore the object of the invention to provide an improved method for the safe storage of calcined high-level radioactive waste.

It is a further object of the invention to provide an improved method for the safe storage of calcined high-level radioactive wastes in metal canisters for long-term storage in a moisture-containing environment.

It is a further object of the invention to provide a method for providing a self-sealing metal canister for the long-term storage of calcined high-level radioactive wastes.

BRIEF DESCRIPTION OF THE PREFERRED EMBODIMENT

These and other objects of the invention may be met by mixing cement powder with the solid calcined high-level radioactive waste in a ratio of from about 1 part cement powder to from about 3 to about 10 parts by weight of calcine before the calcine is placed in the metal canister and sealed for storage in a moisture-containing environment.

It has been assumed that the wastes to be stored will be stable, dry, solid, high-level radioactive wastes. The reference design waste form is a calcine product from Light Water Reactor Uranium (PWR-2) fuels, typically packaged in a stainless steel canister, 12.75 inches outside diameter by 10 feet long, containing 6.3 cubic feet of waste from reprocessing 3.15 metric tons of fuel and generating approximately 3.25 kilowatts of decay heat at 10 years age.

The ratio of cement to calcine will depend upon the physical form of the calcine, i.e., whether it is a fine granular friable material such as sand or of a coarser form such as gravel. In general, a fine granular powder is limited to a ratio of 3 to 1 while a coarser granular form may vary up to a ratio of 10 parts to 1 part cement by weight.

The type of cement may be any of the ordinary Portland cements which have the ability to harden in a high-moisture environment such as where the canister has been placed in a water tank for storage. It may be desirable to use an expansive cement such as Atlas MX (Universal Atlas Co. Div. of U.S. Steel) which will expand about 2 percent as it sets. Because of the high temperatures which the radioactive material in storage may reach, a cement having a high alumina content may also be considered.

The cement may be mixed with the calcine in various ways. For example, the cement powder can be added to the calciner to be mixed with the calcine as it is formed. This would enhance the incorporation of the oxide waste with the cement powder. The cement can also be mixed with the calcine as it is fed into the canister. This would give an even distribution of cement with the calcine within the canister. As another alternative, the cement powder can be inserted into the canister as an outer annulus, with the calcined waste in the center of the canister. This may be accomplished, for example, by inserting a cylindrical sleeve into the canister which is slightly smaller in diameter than the inner wall of the canister so that an annular space about 1 inch deep is formed between the sleeve and the wall, and filling this space with cement powder while filling the center of the sleeve with calcine. The sleeve can then be removed and the canister sealed for storage. This method has the advantage that the amount of cement necessary to provide the self-sealing feature for the canister would be minimized.

It is important that the inner surface of the wall of the canister be in contact with the cement powder so that a breach anywhere in the canister wall which would permit the entrance of moisture either from the cooling basin or from the air will result in the water mixing with and wetting the cement so that it can set, plug the breach and thus prevent the inflow of any more water.

The formation of cement under conditions of leak will, of course, not provide the usual proportioned well-mixed cement-water paste. However, a leak due to corrosion or to a crack in the canister will first open only a very small surface for the entry of water. Since the canister is sealed and the water is only at the pressure of the gravity head in the pool, the water will enter slowly. The temperature is favorable for quick setting of cement, since the temperature of the outer wall of the canister is expected to be about 128°F. Thus, while the point adjacent to the breach in the canister wall may have too much water to form a good cement, the inside portions of cement will not have excess water and a zone of setting proportions will encircle the hole. The leaching of the calcine will be reduced and the integrity of the calcine and of the container will be maintained for a longer time, so that maintenance or removal of the canister can be carried out if desired.

ADVANTAGES OF THIS METHOD a. The properties and further accessibility of the dry calcine are not changed in the normal situation where the canister does not leak.

b. The amount of concrete formation, which may change the accessibility of the calcine, is limited to the amount of water leaked.

c. The formation of monolithic concrete involves the doubling of the volume of solid previously present as dry calcine, thus closing any void space in the calcine and forming a seal against any further water entry or exit of calcine or water.

d. This method is compatible with the formation of a concrete monolith of the calcine prior to canistering and thus should be deemed desirable for this type of interim storage of high-level wastes.

e. No expensive reagents and a minimum of equipment are required to carry out this method of the interim storage of high-level radioactive wastes.

The embodiments of the invention in which an exclusive property or privilege is claimed are defined as follows:

1. In the method of storing high-level radioactive liquid wastes by calcining the waste to remove the liquid, thereby forming a high-level radioactive calcine, placing the calcine in a metal canister, sealing the metal canister and placing the sealed metal canister in a moisture-containing environment for cooling and long-term storage, the improvement comprising: adding powdered portland cement to the canister containing the calcined wastes so that the cement is in contact with the inner surface of the wall of the canister before the canister is sealed, whereby, should the canister wall fail and develop an opening to the environment, moisture from the environment will enter the canister, mix with the portland cement, forming concrete which will harden, seal the opening and prevent the escape of any radioactivity from the canister to the environment.

2. The method of claim 1 wherein the powdered cement is mixed with the calcine to form an intimate mixture before the mixture is placed into the canister.

3. The method of claim 2 wherein the mixture contains at least 1 part by weight of cement powder per 10 parts by weight of calcine.

4. The method of claim 3 wherein the canister is placed in a water-filled tank for cooling and long-term storage.

5. The method of claim 1 wherein the powdered portland cement is added to the canister to form an outer annulus in contact with the inner wall of the canister and the radioactive calcine is in the center of the canister surrounded by the cement.

6. The method of claim 5 wherein the outer annulus of cement powder is at least about 1 inch in thickness.

7. The method of claim 6 wherein the canister is placed in a water-filled tank for cooling and long-term storage.

* * * * *